US005562578A

United States Patent [19]

Guillemette

[11] Patent Number: 5,562,578

[45] Date of Patent: Oct. 8, 1996

[54] ADDUCTOR EXERCISE APPARATUS WITH MEANS FOR ADJUSTING THE ANGULAR STARTING POSITION OF THE LEG MEMBERS

[76] Inventor: Richard Guillemette, 37 Fairview Ave., West Warwick, R.I. 02893

[21] Appl. No.: 183,174

[22] Filed: Jan. 18, 1994

[51] Int. Cl.[6] ..... A63B 23/04

[52] U.S. Cl. ..... 482/100; 482/136

[58] Field of Search ..... 482/94, 97–103, 482/112, 123, 133–137, 908

[56] References Cited

U.S. PATENT DOCUMENTS

| | | | |
|---|---|---|---|
| 3,257,111 | 6/1966 | Martin | 482/98 |
| 4,022,463 | 5/1977 | Scott, Jr. . | |
| 4,125,258 | 11/1978 | McArthur | 482/908 X |
| 4,349,194 | 9/1982 | Lambert, Jr. et al. | 462/136 X |
| 4,478,411 | 10/1984 | Baldwin | 482/136 |
| 4,627,615 | 12/1986 | Nurkowski | 482/98 |
| 4,877,239 | 10/1989 | Dela Rosa . | |
| 4,878,663 | 11/1989 | Luquette | 482/100 |
| 4,892,304 | 1/1990 | DeNiro . | |
| 5,026,049 | 6/1991 | Goodman . | |
| 5,098,361 | 3/1992 | Danylieko | 482/97 |
| 5,108,095 | 4/1992 | Nichols | 482/137 |
| 5,277,681 | 1/1994 | Holt | 482/133 X |

*Primary Examiner*—Richard J. Apley
*Assistant Examiner*—John Mulcahy
*Attorney, Agent, or Firm*—Salter & Michaelson

[57] ABSTRACT

An exercise apparatus for exercising the adductor muscles of the legs includes an adjustment mechanism for adjusting the angular starting positions of the leg receiving assemblies. The exercise apparatus includes a base, two support legs which extend outwardly from opposite sides of the base, a seat on the base, and two leg receiving assemblies for receiving the legs of a user seated on the seat. The leg receiving assemblies are pivotably mounted to the base so that they are pivotably movable between a spread apart position and a parallel, together position. The apparatus further includes a cabled weight assembly for normally urging the leg receiving assemblies toward the spread apart position. The cabled weight assembly includes a stack of weights connectable to an apertured weight bar. The adjustment mechanism consists of a pair of sliding adjustment arms having a first end which engages the respective leg receiving assembly and a second end which is slidably received and secured in a sleeve assembly mounted on the adjacent support leg. arms are slidably adjustable in the sleeve to a plurality of predetermined positions and each position of the arm corresponds to a different angular starting position of the leg receiving assembly. The weight bar is vertically displaced when the angular starting position of the leg receiving assembly is adjusted. The weight bar has more apertures than there are weights in the stack such that the entire weight stack may be utilized regardless of the starting position of the leg receiving assemblies.

3 Claims, 6 Drawing Sheets

ADDUCTOR EXERCISE APPARATUS WITH MEANS FOR ADJUSTING THE ANGULAR STARTING POSITION OF THE LEG MEMBERS

BACKGROUND AND SUMMARY OF THE INVENTION

The instant invention relates to exercise apparatus for exercising the adductor muscles of the legs and more particularly to an adductor exercise apparatus having means for adjusting the angular starting position of the leg receiving members.

Exercise machines, and more particularly, adductor exercise machines, have heretofore been known in the art. In this connection, the U.S. Patents to Scott No. 4,022,463; DeNiro No. 4,892,304; Dela Rosa No. 4,877,239; and Goodman No. 5,026,049 represent the closest prior art to the subject invention of which the applicant is aware.

The patent to Scott discloses an exercise apparatus for exercising the adductor muscles of the legs, however it does not disclose any means for adjusting the starting position of the leg receiving means. The patent to DeNiro discloses an exercise apparatus including a plurality of movable parts which are adjusted by means of pin and hole mechanisms. The patent to Dela Rosa discloses a stretching apparatus having an elongated threaded adjusting shaft in the form of a worm gear for adjusting the degree of split of the leg receiving elements. The patent to Goodman shows leg receiving pads which are adjustable to accommodate different size persons.

The instant invention provides an adductor exercise apparatus which includes an adjustment mechanism for adjusting the angular starting positions of the leg receiving assemblies. More specifically, the adductor exercise apparatus includes a base, two support legs which extend outwardly from opposite sides of the base, a seat on the base, and two leg receiving assemblies for receiving the legs of a user seated on the seat. The leg assemblies are pivotably mounted to the base so that they are pivotably movable between a spread apart position and a parallel, together position. The leg assemblies include a pad assembly including two pads which respectively engage with the thigh and calf portions of the user's leg. The calf pad is slidably movable with respect to the thigh pad. The apparatus further includes a cabled weight assembly for normally urging the leg assemblies toward the spread apart position. The adjustment mechanism consists of a pair of movable adjustment arms each having a first end which engages the corresponding leg receiving assembly, and a second end which is slidably received and secured in a sleeve assembly mounted on the support leg adjacent to the respective leg receiving assembly. The arms are slidably adjustable in the sleeve assemblies to a plurality of predetermined longitudinal positions. In this manner, as the leg receiving assemblies are urged toward their normal spread apart position, the leg receiving assemblies engage with the projecting ends of the adjustment arms to position the leg receiving assemblies in corresponding angular starting positions. The cabled weight assembly includes stacked weight members and a cable system which extends around a series of pulleys for translating pivoting movement of the leg receiving assemblies into vertical movement of the weight members. The weight members are lifted by an elongated weight bar which is attached to the cable system.

Accordingly, it is an object of the instant invention to provide an exercise apparatus for exercising the adductor muscles of the leg.

It is another object to provide an adductor exercise apparatus having an adjustment mechanism for adjusting the angular starting positions of the leg receiving assemblies.

It is yet another object to provide an adductor exercise apparatus including leg receiving means having two separate pads for engaging with the thigh and calf portions of the user's leg.

It is still another object to provide an adductor exercise apparatus having a cabled weight assembly and an elongated weight bar for lifting the weight members of the weight assembly.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 2:
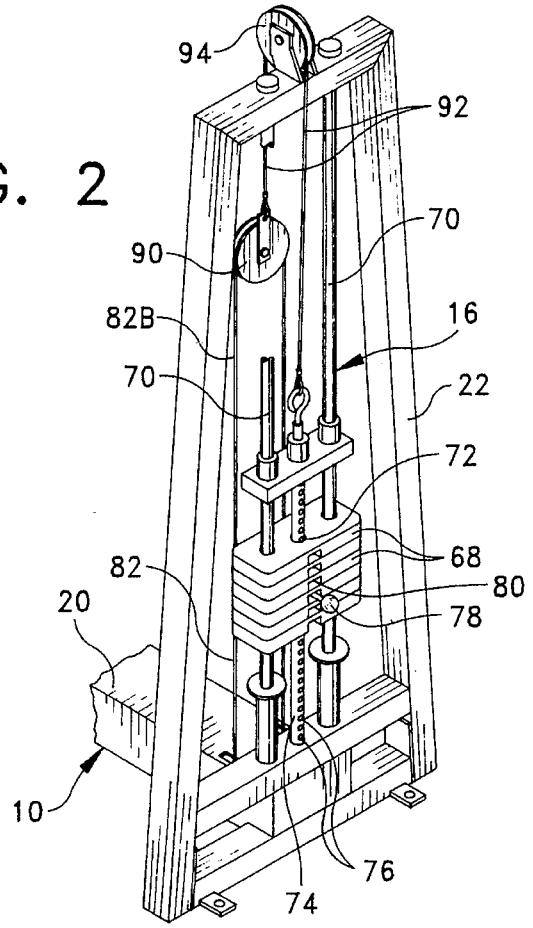
FIG. 2 is fragmented rear perspective view thereof.

Referring now to the drawings, the adductor exercise apparatus of the instant invention is illustrated and generally indicated at 10 in FIGS. 1–6. As will hereinafter be more fully described, the instant invention provides an adductor exercise apparatus 10 which includes an adjustment mechanism for adjusting the angular starting position of the leg receiving assemblies.

The adductor exercise apparatus 10 comprises a frame generally indicated at 10, a seat generally indicated at 12 for supporting a user thereon, two leg receiving assemblies generally indicated at 14 for receiving the legs of a user seated on the seat 12, a cabled weight assembly generally indicated at 16, and two sliding arm mechanisms generally indicated at 18 for adjusting the angular starting position of the leg receiving assemblies 14. The frame 10 is preferably constructed from tubular steel, and it comprises a base portion 20 for supporting the seat 12, an upright portion 22 for supporting the cabled weight assembly 16, and an angled brace 24 extending between the base portion 20 and the upright portion 22. The base portion 20 has a longitudinal centerline indicated at 25 in FIG. 3. The frame 10 further includes two support legs 26 which extend outwardly from opposite sides of the base portion 20. The seat 12 includes a horizontal seat portion 28 and an upright back rest 30.

Figure 1:
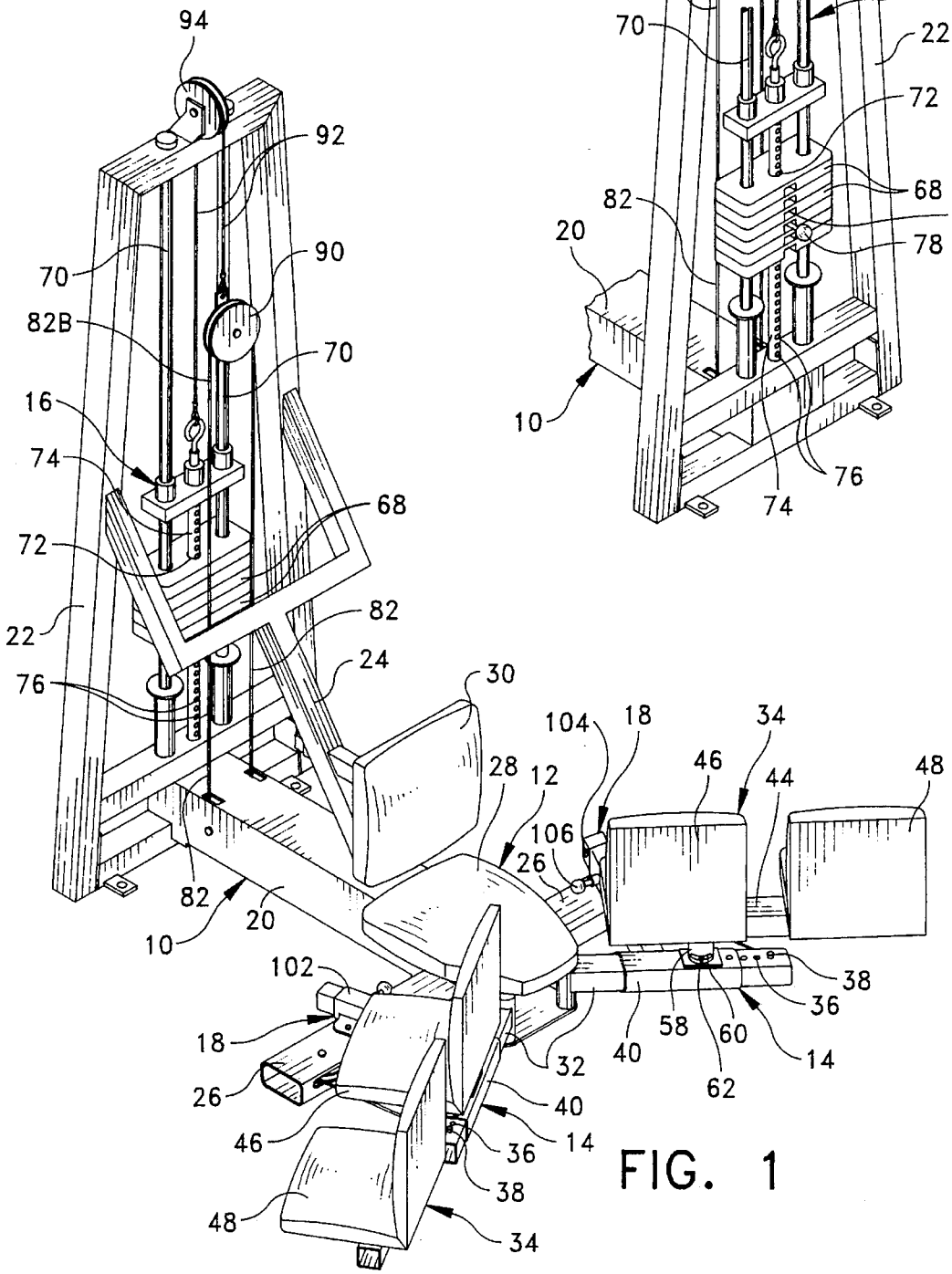
FIG. 1 is a perspective view of the exercise apparatus of the instant invention.
Figure 7:
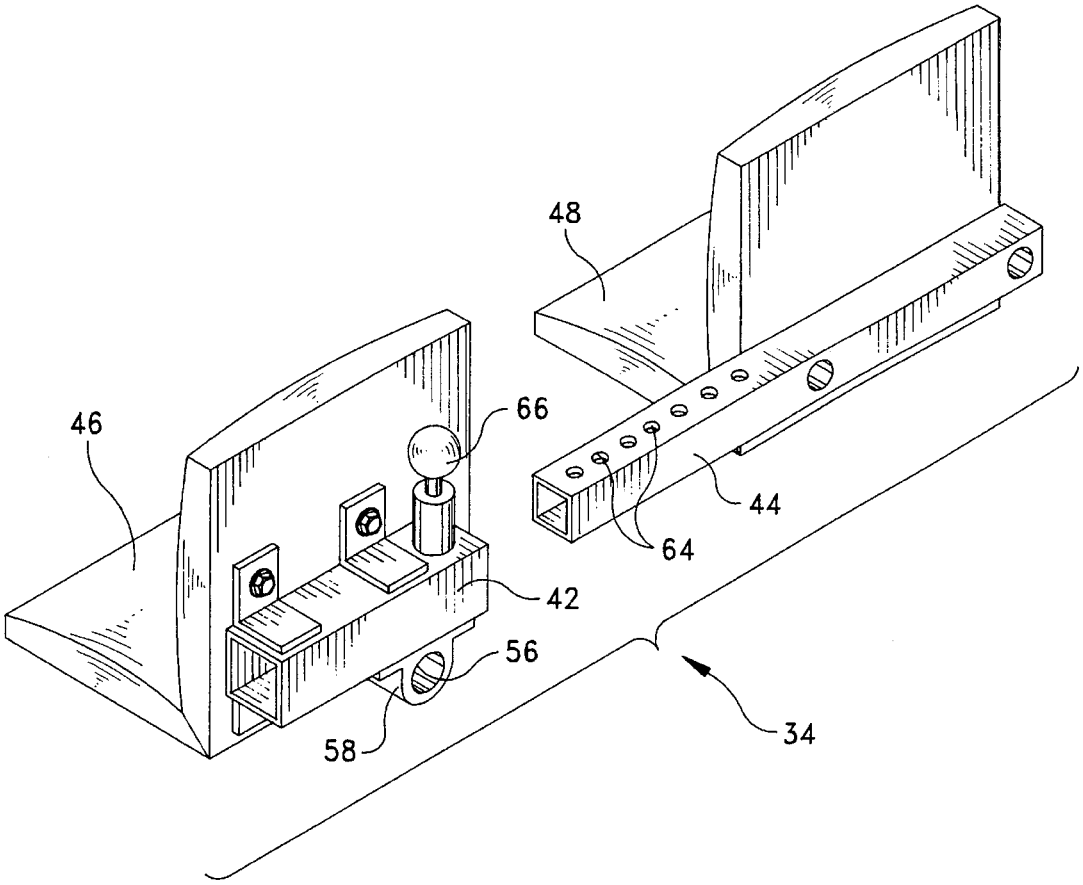
FIG. 7 is an exploded perspective view of the pad assembly.

The leg receiving assemblies 14 are constructed as mirror images and each comprises an elongated, tubular bar 32, and a pad assembly generally indicated at 34 for receiving the legs of a user. Each bar 32 is pivotably mounted to the base portion 20 of the frame 10 adjacent to the seat 12. In this regard, the leg receiving assemblies 14 are pivotably movable between a first spread apart position, (FIG. 3), and a second, parallel position (FIG. 4). The outer end of each bar 32 includes a plurality of vertically disposed holes 36 which extend through the upper and lower walls of the bar 32. The holes 36 are operative for receiving a mounting pin 38 for a cable which interconnects the bars 32 with the cabled weight assembly 16. Each of the pad assemblies 34 comprises a first sleeve member 40 which is slidably received over the respective bar 32, a second sleeve member 42 mounted to the first sleeve member 40, a shaft 44 slidably received into the second sleeve member 42, an L-shaped thigh pad 46 mounted on top of the second sleeve member 42 for engaging the thigh portion of a user's leg, and an L-shaped calf pad 48 mounted on top of the shaft 44 for engaging the calf portion of the user's leg. The entire pad assembly 34 is slidably adjustable relative to the bar 32 to accommodate different size users of the apparatus. In this regard, the bar 32 includes a plurality of longitudinally spaced holes 50 (FIG. 6) along the side thereof, and the first sleeve member 40 includes a spring biased pin 52 (FIGS. 3 and 6) mounted thereon. The pin 52 extends through the wall of the sleeve member 40 and into one of the holes 50 to fix a longitudinal position of the sleeve member 40 with respect to the bar 32. The first sleeve member 40 further includes an upwardly facing post 54 which is received into a downwardly facing recess 56 in an appendage 58 on the second sleeve member 42. The post 54 and recess 56 arrangement enables the second sleeve member 42 to rotate relative to the first sleeve member 40 and bar 32. In this regard, the wall of the appendage 58 includes an elongated slot 60 (FIG. 1). A pin 62 (FIG. 1) is received through the elongated slot 60 and into an aperture (not shown) in the post 54 in order to limit the rotational movement of the second sleeve member 42 relative to the first sleeve member 40. The position of the calf pad 48 is adjustable relative to the thigh pad 46 by means of a spring pin mechanism. In this regard, The shaft 44 is provided with a plurality of longitudinally spaced holes 64 and the second sleeve member 42 includes a spring biased pin 66 (See FIGS. 6 and 7).

The cabled weight assembly 16 is operative for normally urging the leg receiving assemblies 14 to the spread apart position (FIG. 3), and it comprises a plurality of stacked weight members 68 which are mounted for sliding vertical movement along a pair a guide rails 70, and a cable system which extends around a series of pulleys for translating pivoting movement of the leg assemblies 14 into vertical movement of the stacked weight members 68. Each of the stacked weight members 68 includes a central aperture 72 for receiving an elongated weight bar 74 therethrough. The weight bar 74 includes a plurality of apertures 76 therein for receiving a weight pin 78 which extends through a rearwardly facing slot 80 in the weight members 68. The weight pin 78 is receivable into any one of the weight bar apertures 76 for selecting a predetermined number of weight members 68 to be lifted during use of the apparatus. The cable system includes a first cable 82 which couples the first and second leg receiving assemblies 14 together. More specifically, the two opposite ends 82A of the first cable 82 are respectively attached to the ends of the pivot bars 32 by means of the cable mounting pins 38 which are received into the aligned holes 36 in the bars 32. The first cable 82 extends respectively around three pairs of symmetrically positioned pulleys (See FIGS. 3–6). The first pair of pulleys 84 is positioned at the extreme ends of the support legs 26, the second pair of pulleys 86 is positioned at the intersection of the support legs 26 and the base portion 20 of the frame 10 and the third pair of pulleys 88 is positioned at the intersection between the base portion 20 of the frame 10 and the upright portion 22 of the frame 10. The ends 82A of the cable 82 are threaded around the first pair of pulleys 84, through the hollow support legs 26, around the second pair of pulleys 86, through the base portion 20 of the frame 10, around the third pair of pulleys 88 and upwardly so that the center portion 82B of the cable 82 rests along the upright portion 22 of the frame 10. The center portion 82B of the first cable 82 is received around a suspended pulley 90 which is in turn coupled to the weight bar 74 by a second cable 92 threaded around a pulley 94 at the top of the upright portion 22 of the frame 10. It is pointed out that the cable mounting pins 38 may be mounted in any one of the vertical holes 36 in order to adjust the tension of the cable with respect to the weight members 68. Accordingly, it can be seen that downward movement of the stacked weight members 68 pulls the suspended pulley upwardly 90, and thereby normally urges the leg receiving assemblies 14 to the spread apart position. It can further be seen that pivoting movement of the leg receiving assemblies 14 from the spread apart position to the parallel position causes downward movement of suspended pulley 90 and corresponding upward movement of the weight bar 74 and attached weight members 68. Construction and operation of the cabled weight assembly 16 is well known in the art and therefore no further description other than the drawing illustrations will be given.

Figure 3:
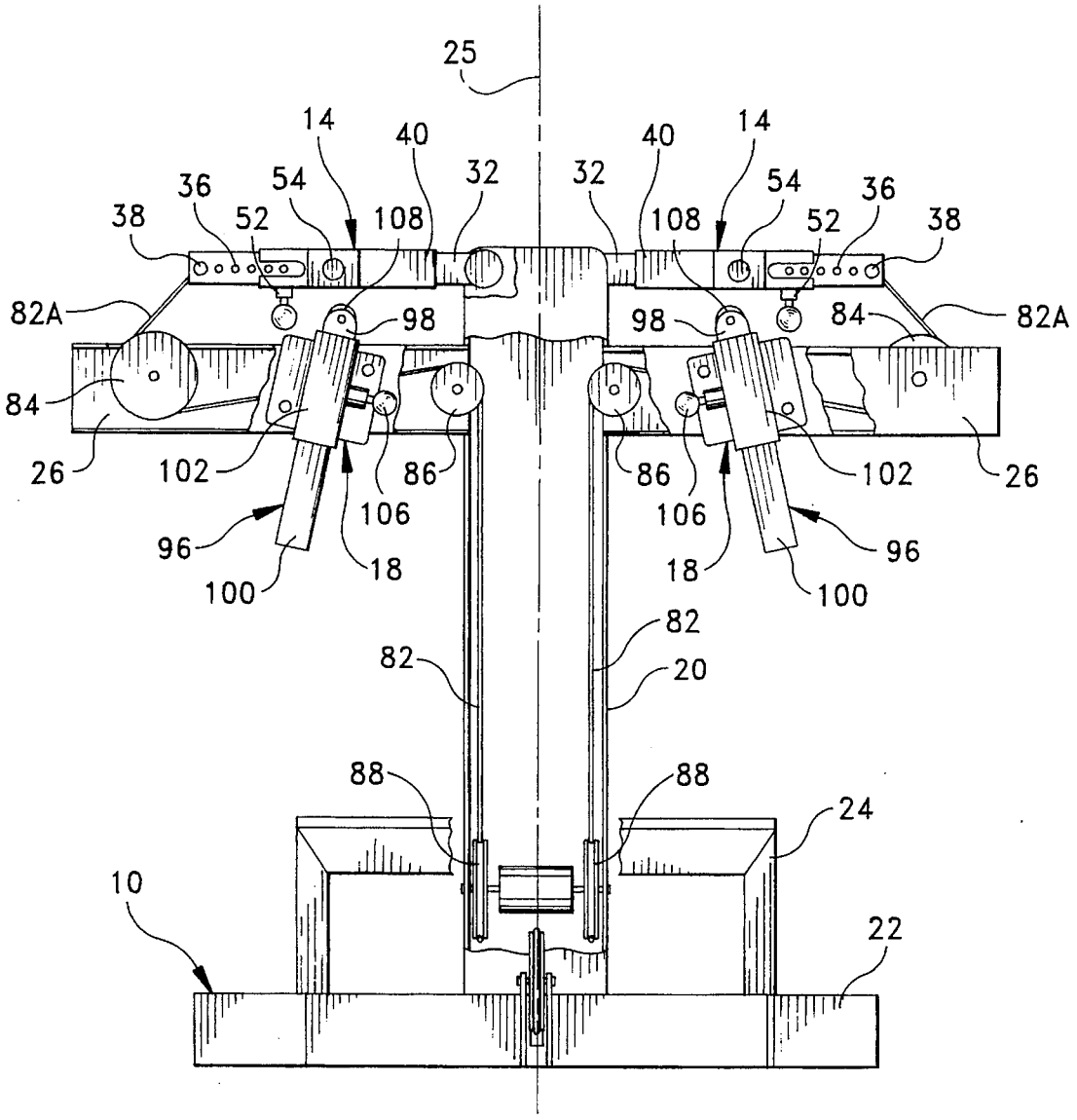
FIG. 3 is a top view with the leg receiving assemblies in the spread apart position, and the seat and pad assemblies removed for purposes of illustration.
Figure 4:
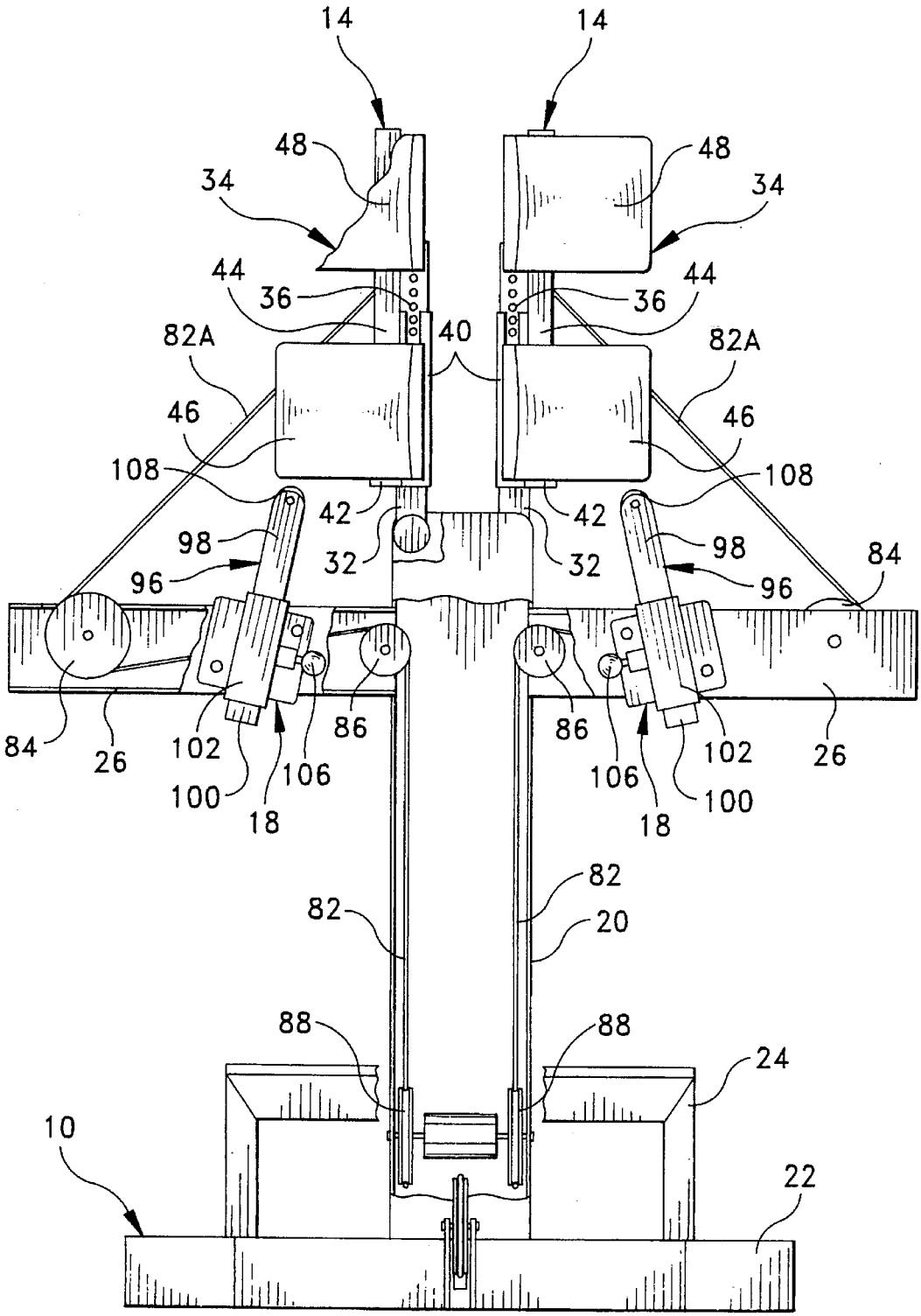
FIG. 4 is another top view thereof with the leg receiving assemblies in the parallel together position.

The sliding arm mechanisms 18 are operative for adjusting the starting position of the leg receiving assemblies 14 to an angular position (see FIG. 5) which is intermediate the first and second extreme positions as illustrated in FIGS. 3 and 4. The sliding arm mechanisms 18 each comprise an arm generally indicated at 96 having a first end 98 which is operative for engaging the bar 32 of the respective leg receiving assembly 14, and a second end 100 which is slidably received and secured into a sleeve assembly 102 mounted on the respective support leg 26. The arm 96 includes a plurality of longitudinally spaced apertures 104 along the side wall thereof, and the sleeve assembly 102 includes a spring-biased pin 106 which extends through the sleeve wall and into one of the apertures 104 for setting a predetermined longitudinal position of the arm 96 with respect to the sleeve 102. As the leg receiving assemblies 14 are urged to their normal spread apart position, they engage with the ends of the adjustment arms 96 and are maintained in a predetermined angular starting position. Accordingly, it can be seen that the different longitudinal positions of the arm 96 with respect to the sleeve 102 determine the different angular starting positions of the leg receiving assemblies 14. (See FIG. 5). The first end 98 of the arm 96 includes a cylindrical roller 108 to facilitate engagement and positioning of the arm 96 with respect to the pivot bar 32.

Figure 5:
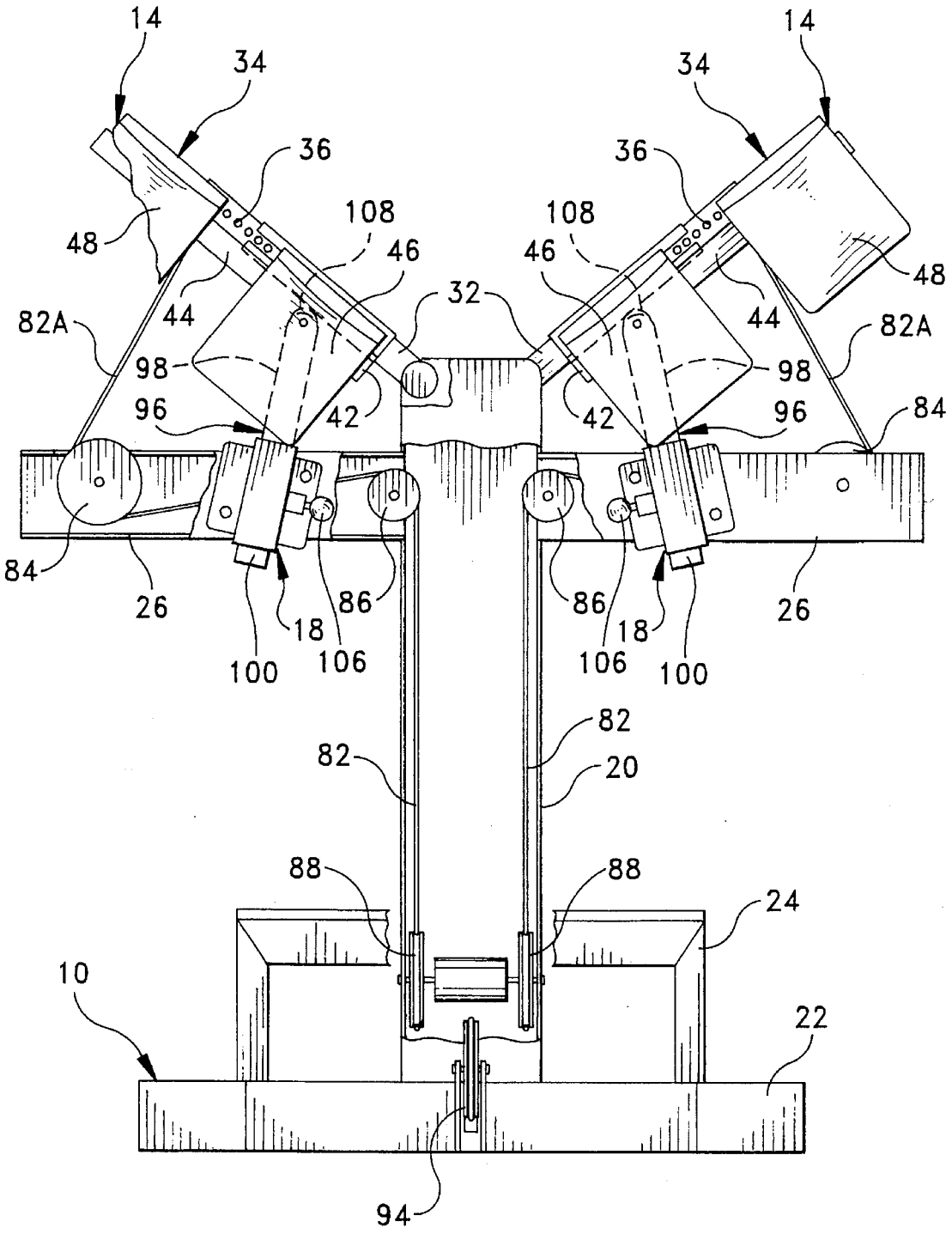
FIG. 5 is yet another top view thereof with the leg receiving assemblies adjusted to an intermediate angular starting position.
Figure 6:
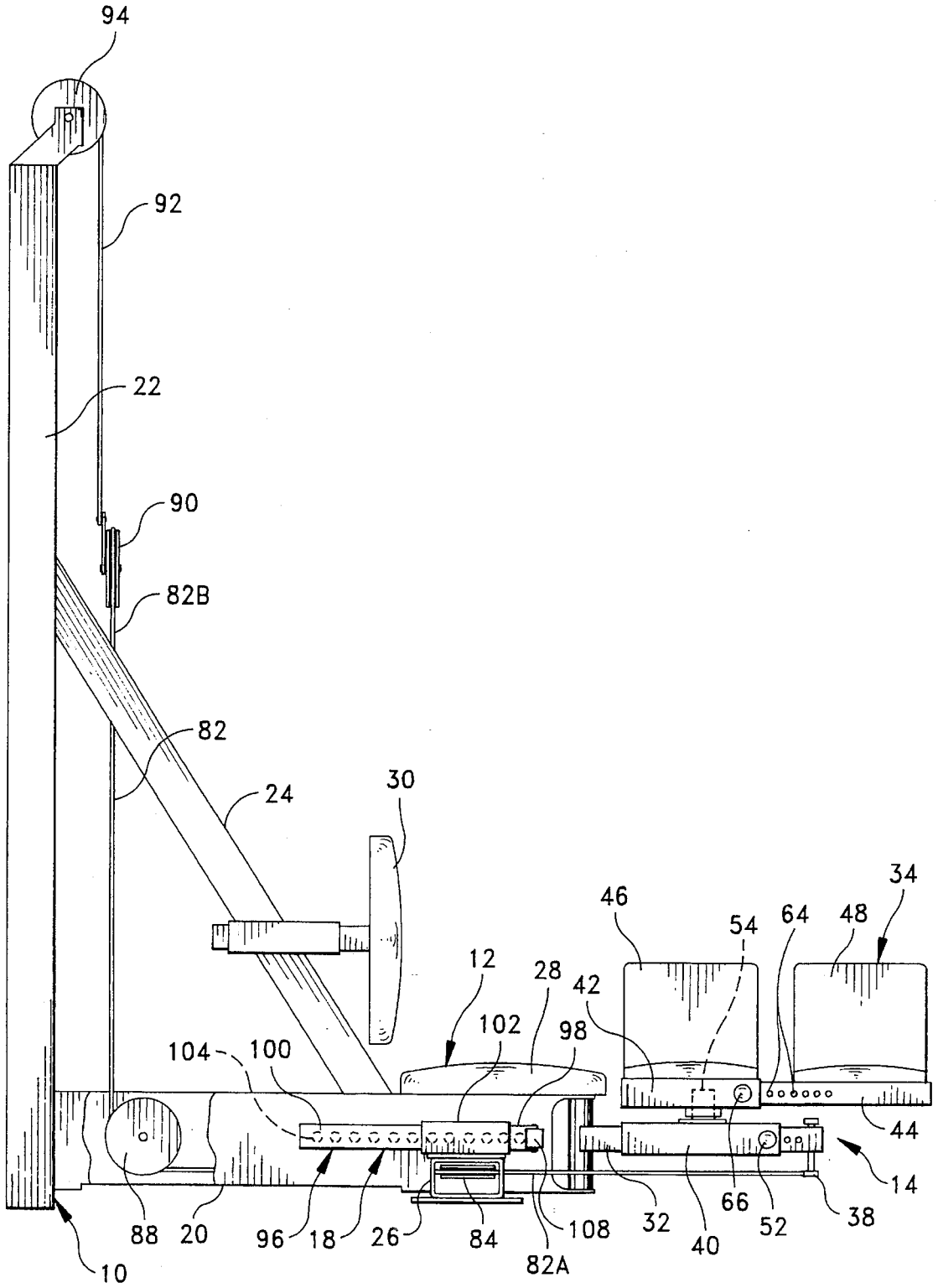
FIG. 6 is a side view of the exercise apparatus.

It is pointed out that the weight bar 74 of the instant invention is slightly longer than a weight bar in a fixed position exercise apparatus. A traditional exercise apparatus has a fixed starting position and therefore the starting position of the weight bar is always the same with regard to the stack of weights it extends through. Since the different angular starting positions of the leg receiving assemblies 14 draw in a different amount of the cable 82 in the instant exercise apparatus, the vertical position of the weight bar 74 changes with the different angular starting positions of the leg receiving assemblies 14. It can be appreciated that the weight bar 74 rests at a lower position when the leg receiving assemblies 14 are fixed in the spread apart position (FIG. 3) than when the leg receiving assemblies 14 are fixed in and angular starting position (FIG. 5). Accordingly, the length of the weight bar 74 in the instant invention must be longer than the height of the stack of weight members 68 to accommodate vertical movement of the weight bar 74 due to changes in the starting position of the leg receiving assemblies 14.

In use, the instant adductor exercise apparatus 10 functions very similar to a traditional adductor exercise machine. The legs of the user are received onto the pads 46 and 48 of the leg receiving assemblies 14 while the user sits on the seat 12, wherein the user squeezes the leg receiving assemblies 14 from the spread apart angular position to the parallel together position to exercise the adductor muscles of the legs.

It can therefore be seen that instant invention provides a unique and novel adductor exercise apparatus having a plurality of adjustment mechanisms for adjusting various aspects of the apparatus. In particular, the adjustable mechanisms of the instant adductor exercise apparatus allow users to adjust the angular starting positions of the leg receiving assemblies 14 as well as the longitudinal positions of the leg pads 46 and 48. In this manner, use of the machine will be comfortable and beneficial for the user. The adjustment of the angular starting position of the leg receiving assemblies 14 is very important because each individual user has a different degree of flexibility and strength, and hence the user may not feel comfortable using a machine having a fixed starting position which is beyond the user's normal degree of flexibility. The instant apparatus 10 allows the user to move the leg receiving assemblies 14 to an angular starting position which is most comfortable for their particular needs. Accordingly, the adjustable features of the invention should encourage more extensive use of this type of apparatus by persons who would not normally be inclined to use it. Once the particular adjustments for the user are accomplished, the instant adductor exercise apparatus 10 functions very similar to a traditional adductor exercise machine. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. Adductor exercise apparatus comprising:

a frame having a base portion including a longitudinal centerline and further including first and second support legs which extend outwardly from opposite sides of said base portion;

a seat mounted on said base portion;

first and second leg receiving means for receiving the legs of a user seated on said seat, said first and second leg receiving means being pivotably mounted to the base portion of the frame and extending outwardly therefrom, each of said first and second leg receiving means being pivotably movable between a first spread apart position wherein said leg receiving means are generally perpendicular to said base portion, and a second together position wherein said leg receiving means are generally parallel to each other, each of said leg receiving means comprising a bar having a first end pivotably mounted to said base portion of said frame, and further comprising a pad assembly slidably received on said bar, said bar being pivotably movable between said first and second positions;

means for normally urging said leg receiving means toward said first spread apart position, said means for normally urging comprising a plurality of stacked weight members mounted for sliding vertical movement along a pair a guide rails, each of said plurality of stacked weight elements including a central aperture for receiving a weight bar therethrough said weight bar including a plurality of apertures therein for receiving a weight pin which is operative for selecting a predetermined number of weight members to be lifted during use of said apparatus, and further comprising a plurality of cables which couple said first and second leg receiving means to said weight bar, said plurality of cables extending around a plurality of pulleys for translating pivoting movement of said leg receiving means into corresponding vertical movement of said weight bar and said weight members; and means for adjustably positioning said first and second leg receiving means at a plurality of predetermined angular starting positions between said first spread apart position and said second parallel position, said weight bar being vertically displaced with respect to said stacked weight elements when said leg receving means are adjusted between said spread apart position and said parallel position, said weight bar having a length which is greater than a height of said stacked weight elements and said plurality of apertures in said weight bar being greater than said plurality of stacked weight elements such that a lowermost aperture in said weight bar is positioned below a lowermost weight element and the entire stack of weight members may be utilized regardless of the predetermined angular starting position of the leg receiving means.

2. In the adductor exercise apparatus of claim 1, said means for adjustably positioning said leg receiving means comprising first and second sliding adjustment arms, said adjustment arms each having a first end which engages with a bar of a corresponding leg receiving means, and a second end which is slidably received and secured into a sleeve assembly mounted to a corresponding support leg, said means for adjustably positioning said leg receiving means further comprising means for setting predetermined longitudinal positions of said adjustment arm in a respective sleeve member, wherein said bars of said leg receiving means engage with the first ends of the adjustment arms to thereby position the leg receiving means in corresponding angular starting positions as the leg receiving means are urged toward their normal spread apart position.

3. In the adductor exercise machine of claim 2, said means for setting a position of said adjustment arm comprising a plurality of longitudinally spaced holes formed along the length said adjustment arm and a spring biased pin mounted on said sleeve assembly, said spring biased pin extending through said sleeve assembly and being received into one of said holes for setting said position of said adjustment arm.

* * * * *